United States Patent [19]

Mitteregger

[11] 4,051,653

[45] Oct. 4, 1977

[54] APPARATUS FOR SPINNING TEXTILE FIBERS

[75] Inventor: Anton Mitteregger, Linz, Austria

[73] Assignee: Dr. Ernst Fehrer Gesellschaft m.b.H. & Co. K.G. Textilmaschinenfabrik und Stahlbau, Linz, Austria

[21] Appl. No.: 757,588

[22] Filed: Jan. 7, 1977

[30] Foreign Application Priority Data

Feb. 2, 1976 Austria ..... 714/76

[51] Int. Cl.[2] ..... D01H 1/12

[52] U.S. Cl. ..... 57/58.89; 19/150; 57/58.95

[58] Field of Search ..... 57/58.89–58.95, 57/156, 50; 19/150, 157

[56] References Cited

U.S. PATENT DOCUMENTS

| | | | |
|---|---|---|---|
| 3,635,006 | 1/1972 | Fehrer | 57/50 |
| 3,636,693 | 1/1972 | Benson et al. | 57/58.95 |
| 3,898,788 | 8/1975 | Fehrer | 57/156 |
| 3,913,310 | 10/1975 | Fehrer | 57/156 |
| 3,972,173 | 8/1976 | Fehrer | 57/58.89 |
| 3,981,137 | 9/1976 | Fehrer | 57/156 |

*Primary Examiner*—John Petrakes
*Attorney, Agent, or Firm*—Kurt Kelman

[57] ABSTRACT

A suction drum has an air-permeable shell and is rotatable about a first axis. A rotary disc is rotatable about a second axis, which crosses said first axis and is spaced therefrom by a distance which is equal to one to two diameters of said drum. Said rotary disc has a generally flat side face that is almost tangential to said shell and defines a tapering gap therewith. Suction means are disposed in said drum and define on said shell an air-permeable suction zone which adjoins said tapering gap. Means are provided for supplying flying fibers into said gap into contact with said suction zone and said side face. Drive means are provided for rotating said drum and disc in such a manner that fibers in contact with said drum and disc are twisted together to form a thread. Thread-withdrawing means are provided for withdrawing said thread in a direction which is approximately parallel to said first axis while holding said thread against rotation. Said drive means are operable to rotate said drum in such a sense that said drum moves generally toward said thread-withdrawing means adjacent to said gap.

3 Claims, 2 Drawing Figures

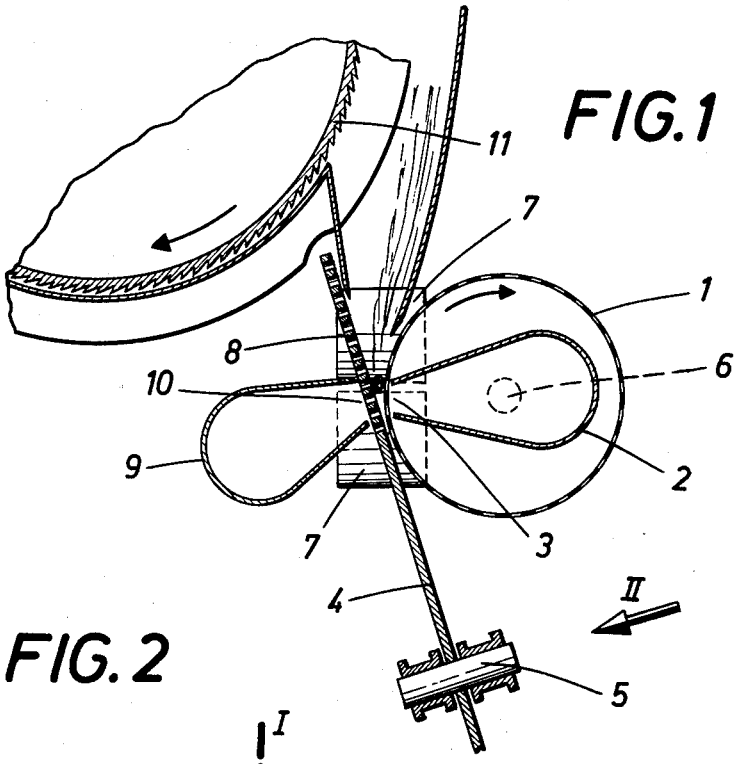
FIG. 1
FIG. 2
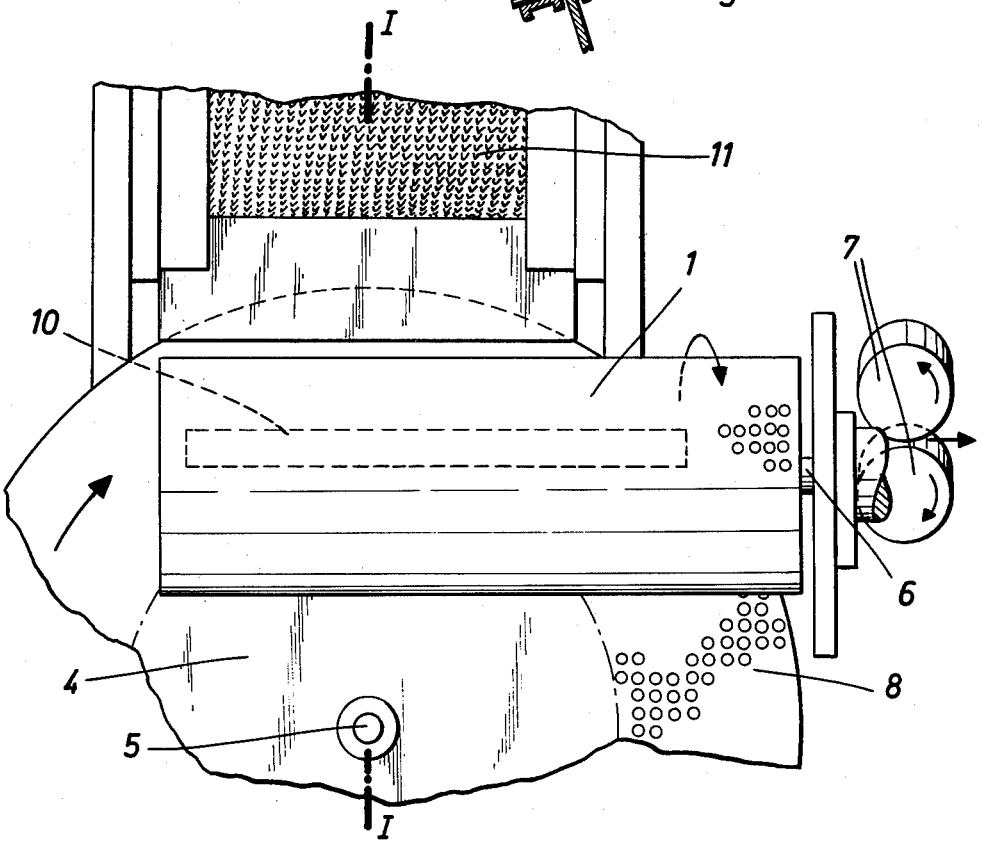

APPARATUS FOR SPINNING TEXTILE FIBERS

This invention relates to apparatus for spinning textile fibers comprising a rotary suction drum and a second movable twisting member, which is associated with said suction drum and defines therewith a tapering gap which adjoins a suction zone of said suction drum, said apparatus being operable to receive flying fibers in said gap, to twist said fibers in said gap to form a thread and to withdraw said thread from said gap approximately parallel to the axis of the suction drum while holding said thread against rotation.

Such apparatus is known from Opened German Specification No. 2,449,583 and has proved satisfactory. In the known apparatus, the second twisting member consists of another suction drum, which has a suction zone that adjoins the tapering gap and faces the suction zone of the first suction drum, and both suction drums have approximately the same diameter and rotate in the same sense. Because the diameter of the suction drum is limited for structural reasons and to save space and expenditure, the angle subtended by the tapering gap between the two suction drums is not equally suitable for all requirements and a narrower gap or a gap subtending a smaller angle would sometimes be desirable. Besides, the thread which forms in the gap is not pushed in its longitudinal direction as the fibers are twisted and such thread must be withdrawn only by the succeeding pair of rolls, which hold said thread against rotation, so that the risk of a thread breakage is increased.

For this reason it is an object of the invention so to improve the apparatus defined first hereinbefore that the tapering gap is narrower or subtends a smaller angle and a smaller force is sufficient to withdraw the thread.

This object is accomplished according to the invention in that the second twisting member consists of a rotary disc, which has a generally flat side face that is almost tangential to the periphery of the suction drum and which has an axis of rotation that crosses the axis of the suction drum and is spaced from the latter axis by a distance which is equal to one to two diameters of the suction drum and that said rotary disc moves adjacent to the tapering gap generally in the direction in which the thread is withdrawn.

Where a flat rotary disc is used rather than a second suction drum, the rotary disc lies approximately in a plane which in an apparatus comprising two suction drums would constitute a plane of symmetry of the two suction drums. As a result, a narrower tapering gap is obtained because the rotary disc virtually bisects the angle which is subtended by the tapering gap in an apparatus comprising said two suction drums. Because the rotary disc moves adjacent to the tapering gap generally in the direction in which the thread is withdrawn, a component of the frictional force acting between the rotary disc and the thread being formed assists the withdrawal of the thread and tends to push the thread in the direction in which it is withdrawn so that the succeeding pair of rolls need not exert an excessive tension. The force exerted by the rotary disc has also a component tending to twist the fibers together because the disc performs a rotation around its axis rather than a mere straight-line movement generally in the direction in which the thread is withdrawn.

Whereas it is known to provide a rotary disc which cooperates with a roll to twist fibers together and to withdraw the thread parallel to the axis of the roll, the rotary disc in the known arrangement is horizontal and serves mainly to receive fibers and to feed them to the roll, which has an axis that is radial with respect of the rotary disc and intersects the axis of the latter at a point rather than crossing the latter axis at a substantial distance therefrom. Besides, the roll serves only to retain the fibers and has no suction means so that there is no proper or satisfactory twisting of the fibers, as has been proved by experiments.

According to a preferred feature of the invention the center of the length of the suction drum is offset toward the thread-withdrawing means from the plane that extends through the axis of the rotary disc and is normal to the axis of the suction drum so that the suction drum is unsymmetrical with respect to said plane and that portion of the suction drum which extends from said normal plane toward the thread-withdrawing means is much larger or longer as that portion which extends from said normal plane toward the approaching disc. This is essential for a good twisting of the fibers because that portion of the rotary disc which approaches said normal plane moves generally in the same direction as the adjacent portion of the periphery of the suction drum and for this reason does not assist the twisting. At said normal plane, a pure pushing force toward the thread-withdrawing means is exerted on the fibers, and only at and behind said normal plane does that portion of the rotary disc which departs from said normal plane exert on the fibers an increasing component of force which assists the suction drum in twisting the fibers.

According to a further preferred feature of the invention, the rotary disc is perforated at least in an annular zone and is provided with suction means which provide a suction zone which also adjoins the tapering gap and faces the suction zone, it can exert a stronger force on the fibers and the conditions adjacent to the rotary disc are similar to those adjacent to the suction drum. This is essential for the twisting because the suction prevents the fibers from leaving the tapering gap and from forcing their way through the throat between the suction drum and the rotary disc; this would strongly adversely affect the spinning operation.

An embodiment of the invention is shown strictly diagrammatically and by way of example on the accompanying drawing, in which FIG. 1 is a vertical sectional view taken on line or plane I—I in FIG. 2 and showing the essential parts of apparatus for spinning textile fibers and FIG. 2 is an elevation taken in the direction of arrow II in FIG. 1.

A suction drum comprises a perforated shell 1, which rotates in the direction of the arrow and contains a suction insert 2, which defines on said shell an air-permeable, relatively narrow suction zone 3. The suction drum 1 cooperates with a rotary disc 4, which has a side face that is almost tangential to the shell 1 of the suction drum. The disc 4 is non-rotatably connected to a shaft 5, the axis of which crosses the axis of a shaft 6 at right angles and is spaced apart from the latter axis by a substantial distance, which is equal to one to two diameters of the suction drum. The shaft 6 is non-rotatably connected to the suction drum 1. As is apparent from FIG. 2, the axis of the suction drum 1 extends along a chord of the rotary disc 4, and the suction drum 1 is unsymmetrical with respect to a plane I—I, which extends through the axis of the shaft 5 carrying the rotary disc and which is normal to the axis of the shaft 6 carrying the suction drum because the center of the length of the suction drum 1 is offset from said normal plane toward thread-withdrawing means which consist of a pair of rolls 7. The rotary disc 4 has a perforated annular zone 8 and is provided with suction means 9, which define an air-permeable suction zone 10, which just as the suction zone 3 of the suction drum 1 adjoins the tapering gap between the shell of the drum and the rotary disc so that the two suction zones 3, 10 face each other. The two suction zones 3, 10 are generally congruent.

Fibrous material to be spun is fed to a serrated drum 11 from a feeder, not shown, and is disintegrated by the drum 11 into individual fibers, which fly from the drum 11 into the tapering gap between the suction drum 1 and the rotary disc 4 and are twisted in said gap to form a thread, which is withdrawn by the pair of rolls generally parallel to the axis of the shaft 6 which carries the drum and the thread is held against rotation at the same time by said rolls.

What is claimed is:

1. Apparatus for spinning textile fibers, which comprises a suction drum having an air-permeable shell and rotatable about a first axis, a rotary disc which is rotatable about a second axis, which crosses said first axis and is spaced therefrom by a distance which is equal to one to two diameters of said drum, said rotary disc having a generally flat side face that is almost tangential to said shell and defines a tapering gap therewith, suction means disposed in said drum and defining on said shell an air-permeable suction zone which adjoins said tapering gap, means for supplying flying fibers into said gap into contact with said suction zone and said side face, drive means for rotating said drum and disc in such a manner that fibers in contact with said drum and disc are twisted to form a thread, and thread-withdrawing means for withdrawing said thread in a direction which is approximately parallel to said first axis while holding said thread against rotation, said drive means being operable to move said disc toward said thread-withdrawing means adjacent to said gap.

2. Apparatus as set forth in claim 1, in which the center of the length of said drum is offset toward said thread-withdraw means from a plane which contains said second axis and is normal to said first axis.

3. Apparatus as set forth in claim 1, in which said side face of said rotary disc is perforated at least in an annular zone which adjoins said tapering gap, and second suction means define in said annular zone a suction zone which adjoins said gap and faces said suction zone of said drum and is substantially congruent with the latter suction zone.

* * * * *